United States Patent [19]

Koitabashi et al.

[11] 4,147,547

[45] Apr. 3, 1979

[54] SILVER HALIDE COLOR PHOTOGRAPHIC MATERIAL

[75] Inventors: Takeo Koitabashi; Noboru Fujimori; Shigemasa Itoh, all of Hino, Japan

[73] Assignee: Konishiroku Photo Industry Co., Ltd., Nihonbashi-Muro, Japan

[21] Appl. No.: 868,461

[22] Filed: Jan. 10, 1978

Related U.S. Application Data

[63] Continuation of Ser. No. 670,568, Mar. 25, 1976, abandoned.

[30] Foreign Application Priority Data

Mar. 29, 1975 [JP] Japan ..... 50-38426

[51] Int. Cl.[2] ..... G03C 1/76

[52] U.S. Cl. ..... 96/74; 96/22; 96/123; 96/124; 96/126

[58] Field of Search ..... 96/124, 123, 74, 126

[56] References Cited

U.S. PATENT DOCUMENTS

| | | | |
|---|---|---|---|
| 3,038,800 | 6/1962 | Luckey et al. | 96/124 |
| 3,432,303 | 3/1969 | Jones et al. | 96/124 |
| 3,717,468 | 2/1973 | Sakazume et al. | 96/124 |
| 3,847,613 | 11/1974 | Sakazume et al. | 96/74 |
| 3,953,215 | 4/1976 | Hinata et al. | 96/124 |
| 4,018,610 | 4/1977 | Hinata et al. | 96/124 |

*Primary Examiner*—J. Travis Brown
*Attorney, Agent, or Firm*—Haseltine, Lake & Waters

[57] ABSTRACT

A light-sensitive silver halide photographic material having improved anti-fogging properties is described.

9 Claims, No Drawings

SILVER HALIDE COLOR PHOTOGRAPHIC MATERIAL

This is a continuation of application Ser. No. 670,568 filed Mar. 25, 1976, now abandoned.

The present invention is related to a light-sensitive silver halide color photographic material which has an improved property of restraining fogs.

In recent years since photographic materials have come to be processed in a shorter time at higher temperatures than ever before, the importance of the roles of fog-restraining agents or anti foggants has increased. Anti foggants such as benzothiazolium salt derivatives and mercapto compounds are well-known and are widely used in the field of manufacturing photographic materials. These compounds exhibit excellent fog-restraining effects but the adsorption of these compounds by the silver halide particles is so strong that, if the amount of these compounds are increased above a certain value, the adsorption of spectral sensitizing dyes to the silver halide particles is interrupted. As a result, there often happens that the spectral sensitizer is readily desorbed from the silver halide, deteriorating the spectral sensitivity of the photographic material.

Even though it is the case that no undesirable effects are observed and the fog-restraining seems to be properly done right after the addition of the restraining agent, the fog-restraining ability of these compounds appears to be inapreciable especially when the photographic material is forced to be stored at a temperature as high as about 40° C. for a long time in manufacturing the photographic material. This fact shows that the performance and function of the spectral sensitizing dyes and these anti fogging agents are changed depending on the lapse of time. Accordingly, such anti fogging agents which have been desired as, when incorporated into a silver halide emulsion layer which contains spectral sensitizing dyes, do not have undesirable effects on the photographic properties. In practice, however, excellent anti fogging agents meeting practical requirements have not been found.

The object of the present invention, therefore, is to provide a light-sensitive silver halide color photographic material which comprises an anti fogging agent which, when incorporated into a silver halide emulsion containing spectral sensitizing dyes, does not impair photographic performance such as spectral sensitizing or fog-restraining effect. Furthermore, the object of the present invention is to provide an anti fogging agent which, when incorporated in a silver halide emulsion containing spectral sensitizing dyes, does not cause the desorption of the spectral sensitizing dyes from a silver halide grain thereby deteriorating the performance of spectral sensitization, or does not give any changes in photographic properties even when the color photographic material is preserved in an atmosphere of higher temperature for a long time due to the manufacturing method of a photographic material. We, the inventors of the present invention found that the aforesaid objects of the invention can be attained when at least one compound represented by the following general formula is incorporated in a red-sensitive emulsion layer, and preferably in a green-sensitive emulsion layer in addition thereto, of the light-sensitive silver halide color photographic material:

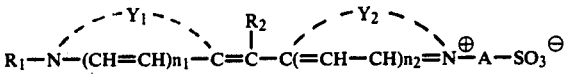

wherein $Y_1$ and $Y_2$ each represents non-metallic atoms necessary to complete a nitrogen-containing heterocyclic ring selected from the group consisting of pyrroline, thiazoline, thiazole, benzothiazole, naphthothiazole, selenazole, benzoselenazole, naphthoselenazole, oxazole, benzoxazole, naphthoxazole, imidazole, benzimidazole or pyridine, and wherein said nitrogen-containing heterocyclic ring may be substituted by a halogen lower alkyl, lower alkoxy, or phenyl; $R_1$ represents lower alkyl, hydroxyalkyl, carboxyalkyl or sulfoalkyl; $R_2$ represents hydrogen or lower alkyl; A represents alkylene, $-(CH_2)_2O(CH_2)_2$ or $$-(CH_2)_2OCH_2\cdot\underset{\underset{OH}{|}}{CH}CH_2;$$

and $n_1$ and $n_2$ individually represent 0 or 1.

Typical examples of the compounds of the present invention are as follows:

(1)

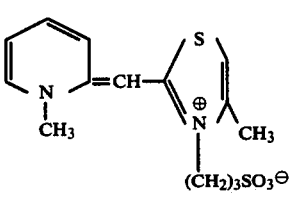

(2)

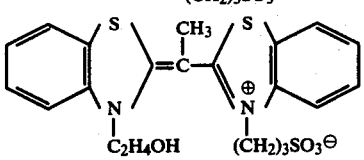

(3)

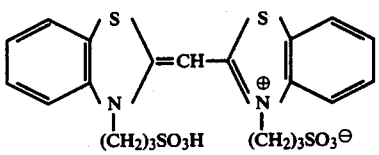

(4)

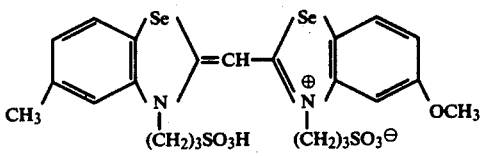

(5)

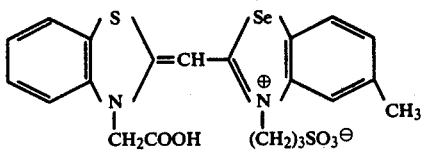

(6)

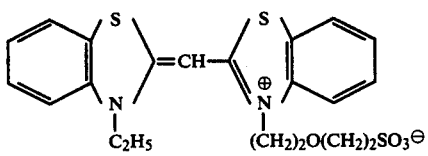

(7)

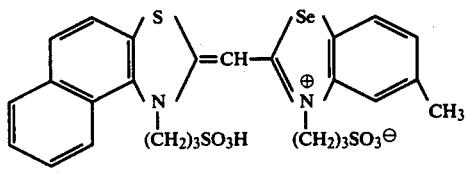

-continued (8)

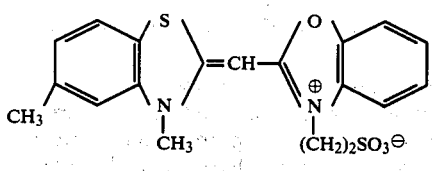

(9)

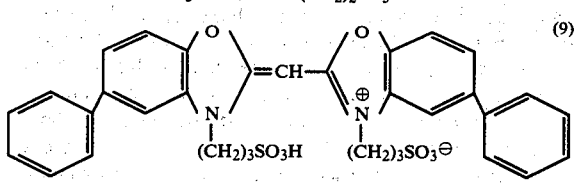

(10)

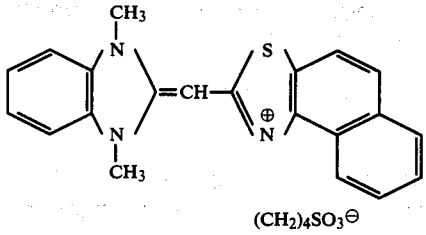

(11)

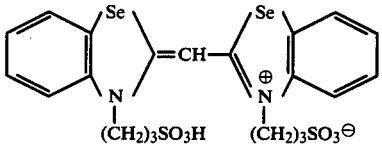

(12)

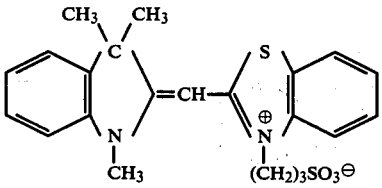

(13)

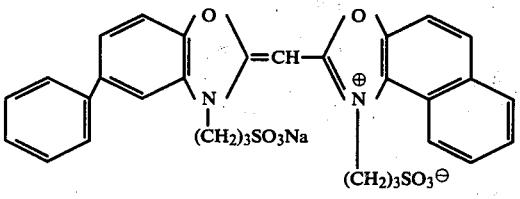

(14)

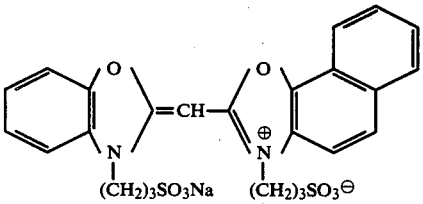

(15)

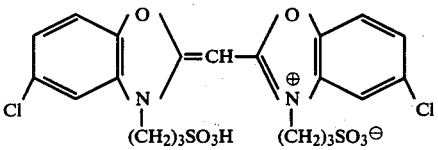

(16)

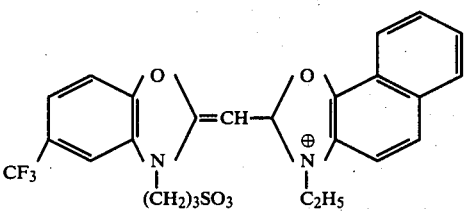

-continued (17)

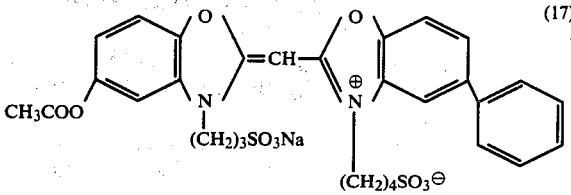

(18)

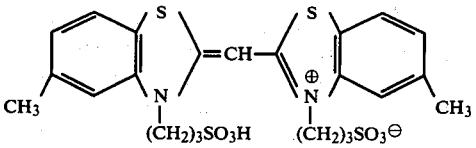

(19)

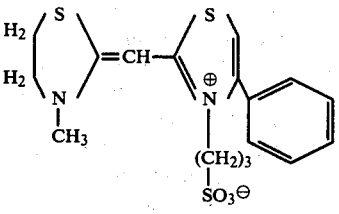

(20)

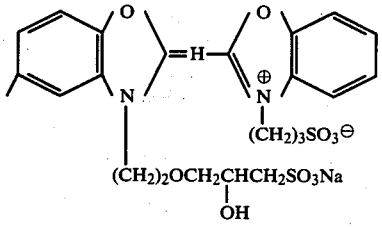

(21)

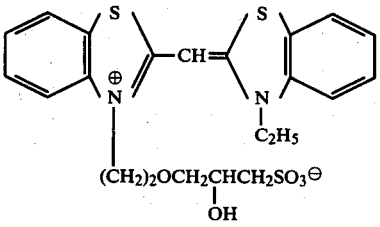

(22)

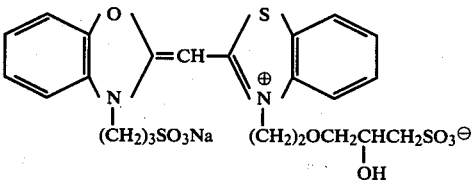

These compounds employed in the present invention are known as spectral sensitizing dyes usually used in a blue-sensitive emulsion layer of a silver halide photographic material. However, it has not been expected that (a) when the compound is incorporated in the red-sensitive emulsion layer of the color photographic material, and preferably in the green-sensitive emulsion layer in addition thereto, in an amount of 0.3 g per mole of silver halide, for instance, no sensitivity reduction in the red-sensitive layer and the green-sensitive layer caused by the desorption of the spectral sensitizing dyes from the silver halide grain is observed, (b) the compound exhibits increased fog-restraining effects, and effectively restrains the fog that is caused, particularly by quick and high-temperature processing, (c) even when the silver halide emulsion containing spectral sensitizing dyes in additor to the compound of the present invention, is stored for a long time, the photographic performance is not varied, exhibiting the desired fog restraining effects, and (d) that the silver halide emulsion comprising the compound of the present invention does not invite varied photographic performance even under various conditions of development, and exhibits very stable performance.

In order to add the compound of the present invention to a silver halide emulsion, the compound is preferably dissolved in an organic solvent such as methyl alcohol or ethyl alcohol which can be mixed easily with water, and then added to the emulsion. The compound can be added to the silver halide emulsion at any time during the preparation process of the emulsion, but usually added just after the step of chemical ripening. The amount of the compound to be added differs depending upon the kind of the compounds and the silver halide emulsions. But usually, the compound is added in an amount of, for example, 0.01 to 1 g, and preferably 0.08 to 0.5 g per mole of the silver halide.

There is no particular limitation to the coupler that may be contained in the silver halide color photographic material of the present invention; ordinarily employed couplers are effectively used.

The silver halide color photographic materials of the present invention can further contain other photographic additives, such as stabilizers or anti foggants, gelatin hardeners, pH adjusting agents, viscosity thickners, coating aids and anti-staining agent. Further, natural and synthetic high molecular compounds such as gelatine, casein or polyvinyl alcohols, can be used alone or in combination as binders. The silver halides to be employed in the silver halide emulsion of the present invention may be silver chloride, silver bromide, silver bromochloride, silver iodobromochloride or silver iodobromide; but particularly, the silver iodobromide is effective.

Examples of a support on which the silver halide emulsion of the present invention is coated, may be a paper, a cellulose acetate film, a polyester film, a polycarbonate film, a polyolefincoated paper, etc.

Examples of green-sensitive or red-sensitive spectral sensitizing dyes to be incorporated in the silver halide emulsion of the present invention, are as follows:

[Green-sensitive spectral spectral sensitizing dyes]

(D - 1)

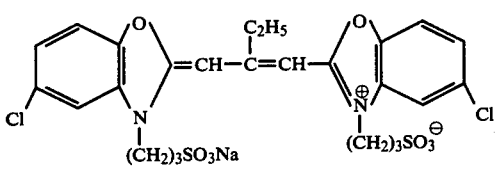

(D - 2)

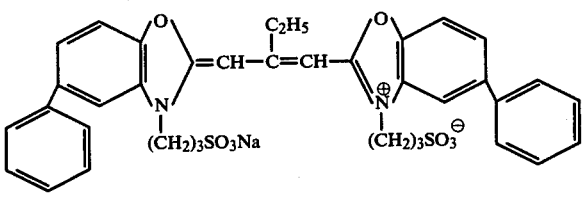

(D - 3)

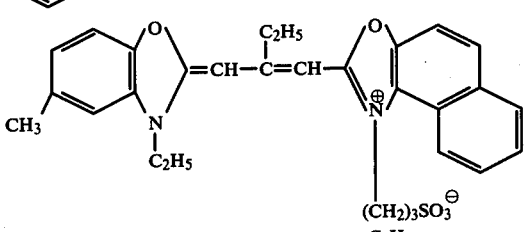

(D - 4)

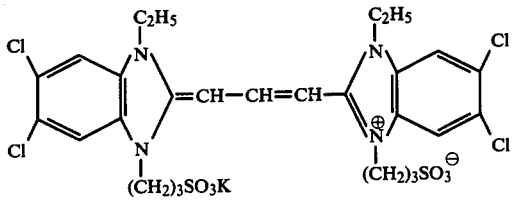

(D - 5)

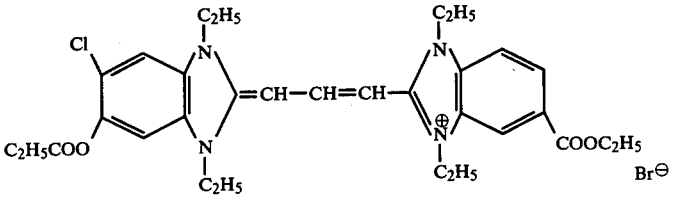

(D - 6)

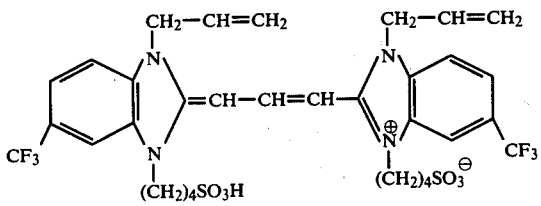

-continued
(D - 7)
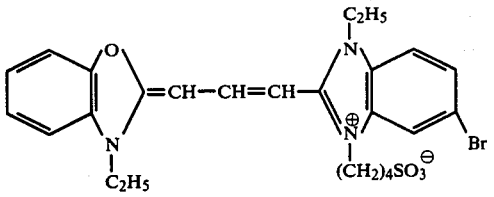
(D - 8)
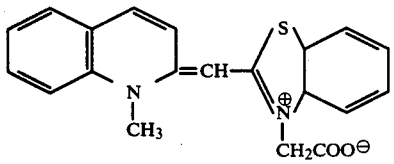
(D - 9)
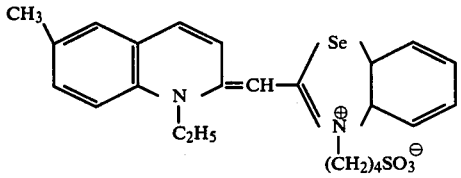
(D - 10)
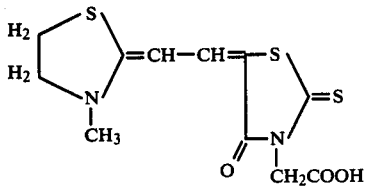
(D - 11)
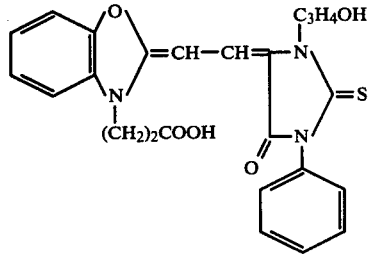
[Red-sensitive spectral sensitizing dyes]
(D - 12)
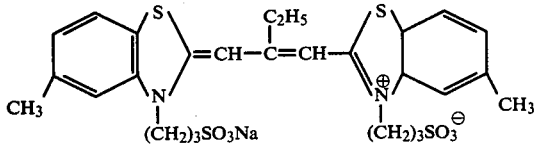
(D - 13)
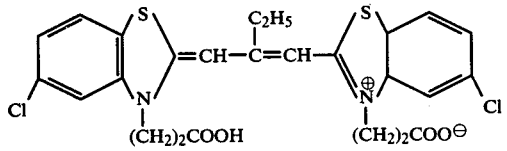
(D - 14)
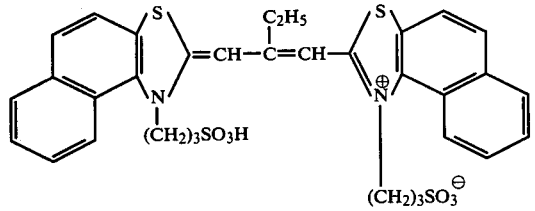

-continued
(D - 15)
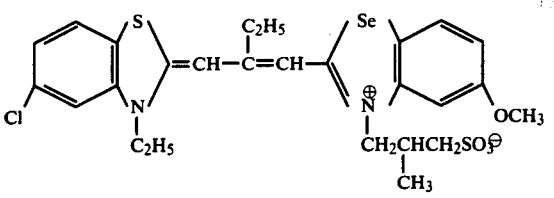
(D - 16)
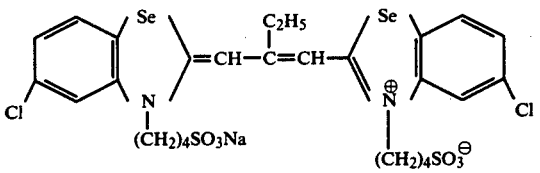
(D - 17)
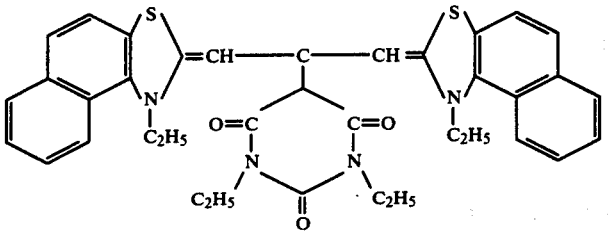
(D - 18)
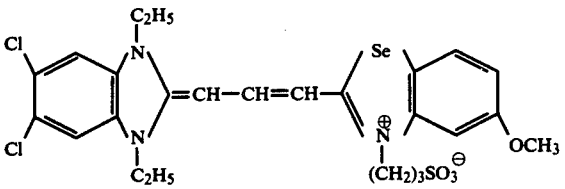
(D - 19)
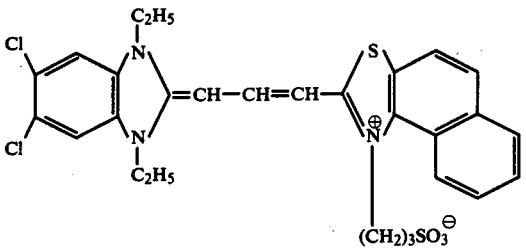
(D - 20)
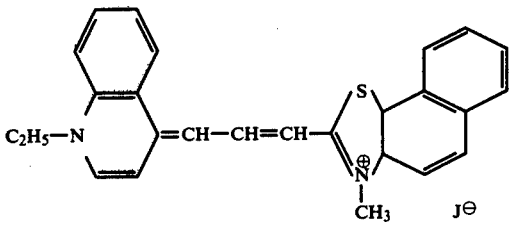
(D - 21)
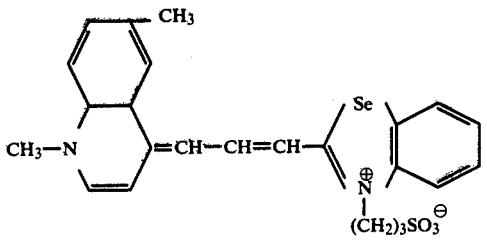
Typical examples of couplers which are preferably employed in the silver halide emulsions of the present invention may be as follows:
[Yellow coupler]

-continued
(K - 1)
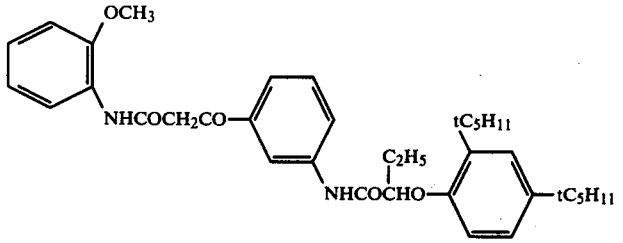
(K - 2)
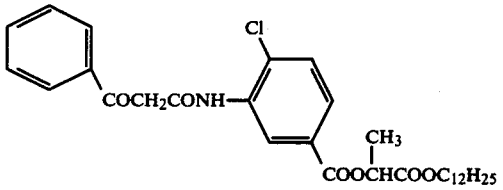
(K - 3)
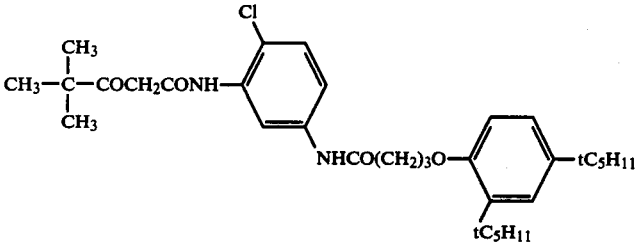
(K - 4)
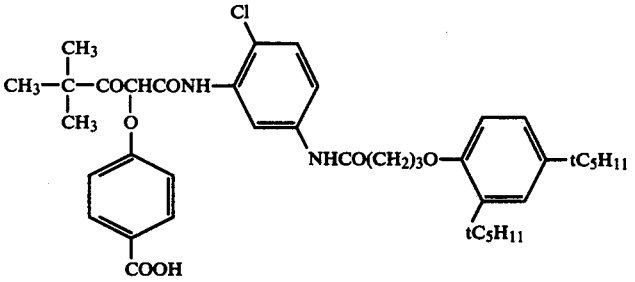
(K - 5)
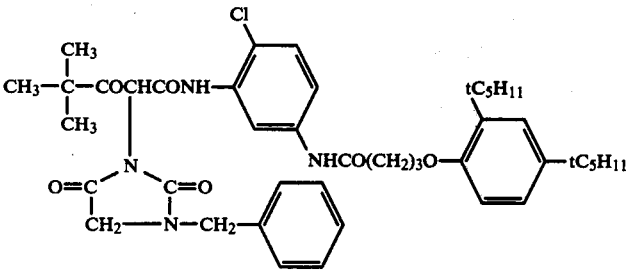
[Magenta coupler]
(K - 6)
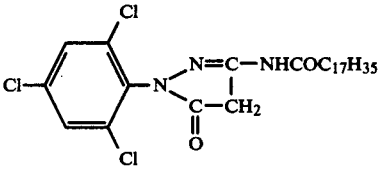
(K - 7)
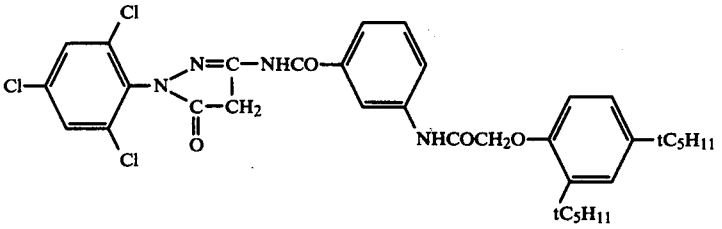

-continued (K - 8)

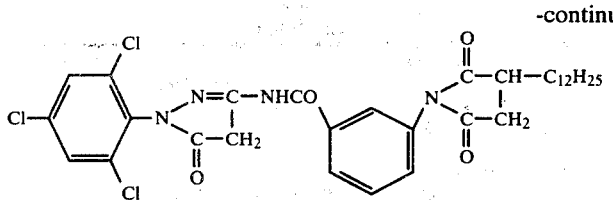

(K - 9)

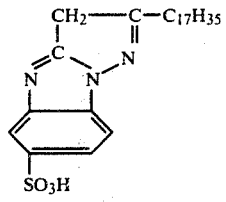

(K - 10)

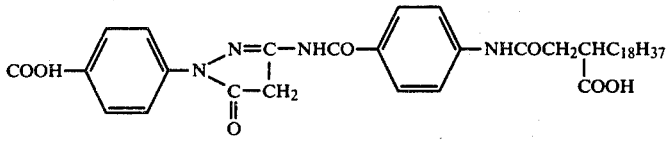

[Cyan coupler]

(K - 11)

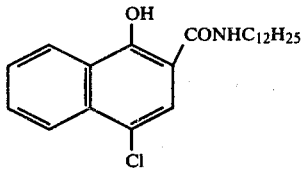

(K - 12)

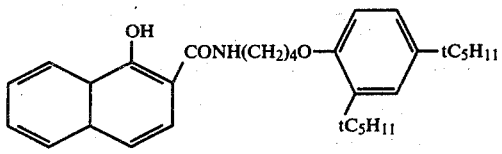

(K - 13)

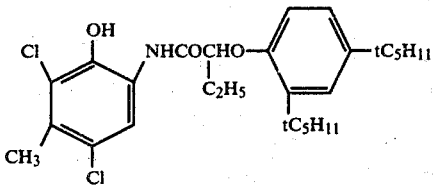

(K - 14)

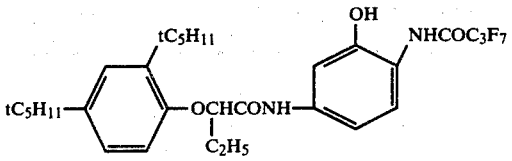

(K - 15)

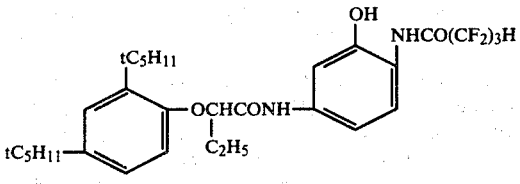

Next, the invention is explained below more concretely with reference to Examples, but it should be noted that the embodiments of the present invention shall not be limited thereby.

EXAMPLE 1:

A negative emulsion for color photography comprising silver iodobromide containing 6 mole % of a silver iodide, was subjected to the chemical ripening, and to which was added an example compound (D - 12) as a spectral sensitizing dye in the form of a methyl alcohol solution in an amount of 0.15 g per mole of silver halide.

Also, the example compound (K - 12) which serves as a coupler was added in the form of a dispersion liquid of the below-mentioned composition in an amount of 50 g per mole of the silver halide. To the silver halide emulsion were added 4-hydroxy-6-methyl-1,3,3*a*,7-tetrazaindene as a stabilizer, a mucochloric acid which serves as a gelatin hardener, saponin which serves as a coating aid and a pH adjusting agent, to prepare a red-sensitive emulsion.

| (Composition of coupler dispersion liquid): | |
|---|---|
| Coupler | 100 g |
| Dibutylphthalate | 100 ml |
| Ethyl acetate | 300 ml |
| 5% Aqueous solution of alkanol XC (du Pont Co.) | 130 ml |
| 6% Gelatin aqueous solution | 500 ml |

The so obtained red-sensitive emulsion was divided into five groups, and one group among them was taken out and coated on a cellulose acetate film base which has an anti halation layer, and on which was formed a gelatin intermediate layer. Then a green-sensitive emulsion was prepared in the same manner as the above-mentioned red-sensitive emulsion with the exception of using the example compound (D - 2) which serves as a spectral sensitizer in an amount of 0.15 g per mole of the silver halide and the example compound (K - 7) which serves as a coupler in an amount of 60 g per mole of the silver halide. The so obtained emulsion was coated on said red-sensitive emulsion layer. And on said green-sensitive emulsion layer was further formed a yellow-color filter layer containing colloidal silver.

Then, chemical sensitization was imparted to the silver iodobromide emulsion which contains 5 mole % of silver iodide, and to which was added the exemplified compound (9) of the present invention in an amount of 0.15 g per mole of silver halide, and to which were further added a stabilizer, a gelatin hardener, a coating aid and a pH adjustor in the same manner as set forth in the red-sensitive emulsion, to prepare a blue-sensitive emulsion. The so obtained blue-sensitive emulsion was coated on said green-sensitive emulsion layer, and on which was further formed a gelatin protective layer to prepare a comparative specimen (specimen No. 1). Specimens (specimen Nos. 2, 3, 4 and 5) were also prepared, in the same manner as the comparative specimen with the exception of adding the exemplified compounds Nos. 2, 4, 9 or 12 to said red-sensitive emulsion.

These specimens and comparative specimens were exposed to the light of 160 lux day-light color (5400° K.) using a KS-1 type sensitometer (manufactured by Konishiroku Photo Industry Co., Ltd.) and then subjected to the treatments of first development, stopbath, color development, bleaching and fixing, according to the below-mentioned processing steps and compositions:

| (Processing steps) | Treating time | Treating temperature |
|---|---|---|
| First development | 3 minutes | 38° C. |
| First stopping | 30 seconds | 38° C. |
| Washing | 1 minute | 38° C. |
| Color development | 3 minutes and 40 seconds | 43° C. |
| Second stopping | 30 seconds | 38° C. |
| Washing | 1 minute | 38° C. |
| Bleaching | 6 minutes | 38° C. |
| Fixing | 6 minutes | 38° C. |
| Washing | 3 minutes | 38° C. |
| Stabilizing | 30 seconds | 38° C. |
| (Solution for the first development) | | |
| Sodium polyphosphate | | 2.0 g |
| Sodium bisulfite (anhydrous) | | 8.0 g |
| Phenydon | | 0.35 g |
| Sodium sulfite | | 37.0 g |
| Hydroquinone | | 5.5 g |
| Sodium carbonate | | 33.0 g |
| Sodium thiocyanate (10% aqueous solution) | | 13.8 ml |
| Sodium bromide | | 1.3 g |
| Potassium iodide | | |

-continued

| | |
|---|---|
| (0.1% aqueous solution) | 23.0 ml |
| Water was added so that the total content was 1 liter, and the pH was adjusted to 9.9 ± 0.01. | |
| (First stop solution) | |
| Sodium hydroxide | 1.75 g |
| Glacial acetic acid | 30 ml |
| Water was added so that the total content was 1 liter, and the pH was adjusted to 3.8. | |
| (Solution for the color development) | |
| Sodium polyphosphate | 5.0 g |
| Benzyl alcohol | 4.5 g |
| Sodium sulfite | 7.5 g |
| Trisodium phosphoric acid dodecahydrate | 36.0 g |
| Sodium bromide | 0.9 g |
| Potassium iodide (0.1% aqueous solution) | 90 ml |
| A sodium hydroxide was added in an appropriate amount as a pH adjusting agent. | |
| 4-Amino-N-ethyl-N(β-methanesulfonamide ethyl)-m-toluidinesesquisulfate monohydrate | 11.0 g |
| Ethyleneamine | 3.0 g |
| t-Butylaminoborane hydride | 0.07 g |
| Water was added so that the total content was 1 liter, and the pH was adjusted to 11.65 ± 0.1. | |
| (Bleaching solution) | |
| Ethylenediaminetetraacetic acid (EDTA) ferric ammonium salt | 170 g |
| Ammonium bromide | 300 g |
| Water was added so that the total content was 1 liter, and the pH was adjusted to 5.8 tp 6.0. | |
| (Fixing solution) | |
| Sodium thiosulfate (anhydrous) | 94.5 g |
| Sodium bisulfite (anhydrous) | 17.6 g |
| Bisodium phosphate (anhydrous) | 15.0 g |
| Water was added so that the total content was 1 liter, and the pH was adjusted to 5.9 ± 0.2. | |

In order to test the stability against the change of processing conditions, the first developing process was conducted for 3 minutes and 5 minutes separately. The dye image density of the so-obtained specimens and the comparafive examples were measured through a red-filter to find Dmax and the sensitivity of the red-sensitive emulsion layer. The results are listed in Table 1.

Table 1

| Photographic performance | | Dmax | | Sensitivity | |
|---|---|---|---|---|---|
| Sample No. | | 3 min. | 5 min. | 3 min. | 5 min. |
| Comparative specimen | 1 | 2.95 | 2.05 | 100 | 230 |
| Specimen | 2 | 3.45 | 3.00 | 98 | 140 |
| | 3 | 3.30 | 2.90 | 97 | 135 |
| | 4 | 3.55 | 3.23 | 98 | 127 |
| | 5 | 3.20 | 2.81 | 100 | 175 |

Table 1 above teaches that when developed for 3 minutes as commonly done, the specimens according to the present invention have higher Dmax, less reduction in sensitive and less fog than the comparative specimen. Further, when the first developing time is extended to 5 minutes, the specimens exhibit less reduction in Dmax than the comparative specimen.

EXAMPLE 2

A silver halide color photographic material comprising a red-sensitive emulsion layer, a green-sensitive emulsion layer and a blue-sensitive emulsion layer were prepared in the same manner as in Example 1, with the exception of using an exemplified compound (D - 13) as a spectral sensitizer for the red-sensitive emulsion layer and using an exemplified compound (K - 14) as a coupler. Comparative specimen (specimen No. 6) was prepared also in the same manner as in Example 1. Specimens (specimen Nos. 7, 8, 9 and 10) were also prepared in the same manner as the comparative specimen with the exception of adding the exemplified compound No. 3, 6, 8 or 11 of the present invention to the red-sensitive emulsion layer and to the green-sensitive emulsion layer. These specimens and comparative specimen were exposed and developed in the same manner as in Example 1 to measure the Dmax and the sensitivity of the red-sensitive emulsion layer, and the Dmax and the sensitivity of the green-sensitive emulsion layer. The results were as shown in Table 2.

Table 2

| Specimen No. | Photographic performance | Amount of compound added per mole of silver halide: Red-senitive layer | Amount of compound added per mole of silver halide: Green-sensitive layer | Red-sensitive layer: Dmax | Red-sensitive layer: Red-sensitivity | Green-sensitive layer: Dmax | Green-sensitive layer: Green sensitivity |
|---|---|---|---|---|---|---|---|
| Comparative specimen | 6 | — | — | 2.65 | 100 | 2.63 | 100 |
| Specimen | 7 | Example compound No. 3 0.2 g | Example compound No. 3 0.1 g | 3.15 | 98 | 2.63 | 96 |
| | 8 | Example compound No. 6 1 g | Example compound No. 6 0.5 g | 3.20 | 87 | 3.12 | 90 |
| | 9 | Example compound No. 8 0.5 g | Example compound No. 8 0.3 g | 3.18 | 93 | 3.22 | 94 |
| | 10 | Example compound No. 11 0.3 g | Example compound No. 11 0.1 g | 3.44 | 90 | 3.00 | 88 |

Table 2 makes it clear that the use of the compounds of the present invention helps to restrain causing of fog that appears in the first development, and accordingly give very large Dmax in the color pictures obtained through color development, as compared to that of the comparative specimen, and in addition, do not lose the sensitivity.

What we claim is:

1. In a light-sensitive silver halide color photographic material comprising at least one red-sensitive silver halide emulsion layer sensitized with a red-sensitive dye selected from the group consisting of:

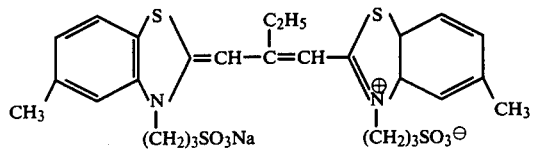

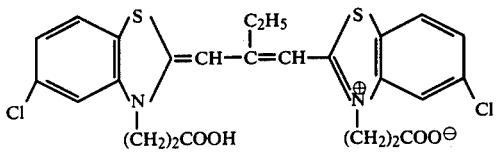

-continued

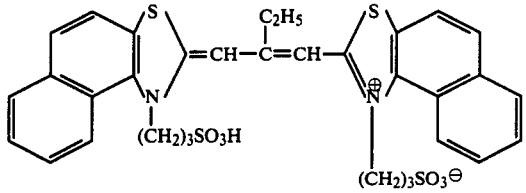

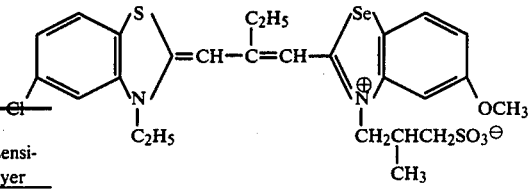

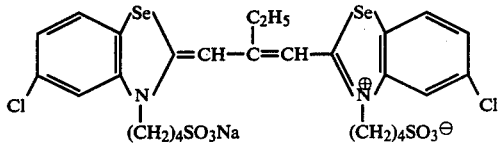

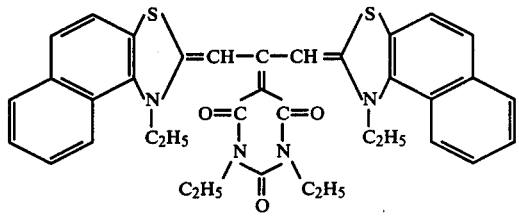

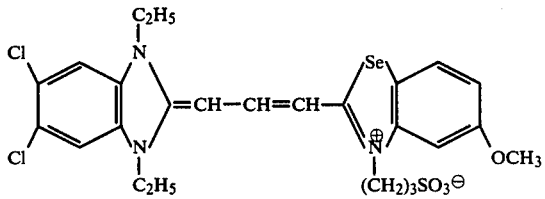

-continued
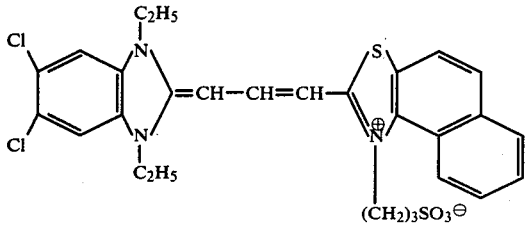
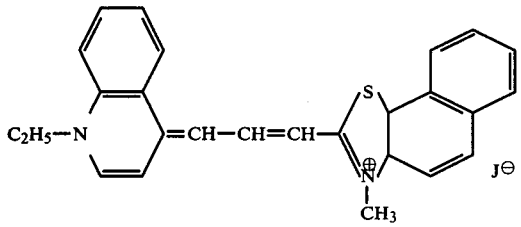
and
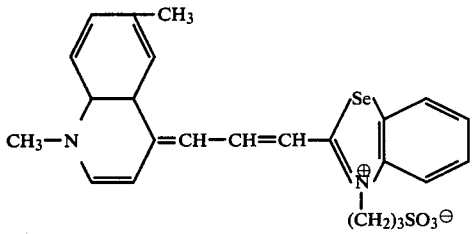
and a green-sensitive silver halide emulsion layer sensitized with a green sensitizing dye, selected from the group consisting of
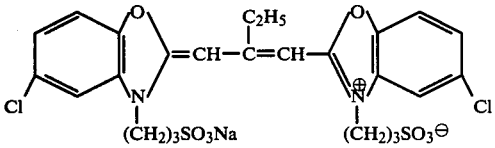
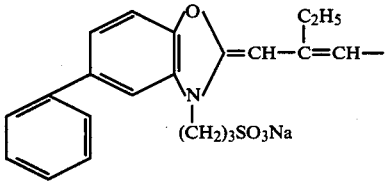
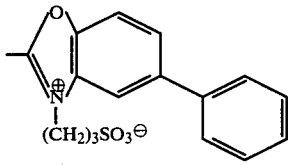
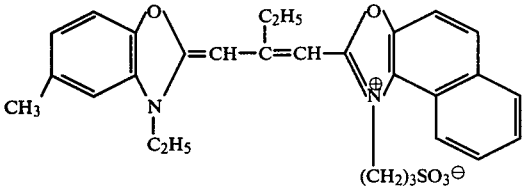
-continued
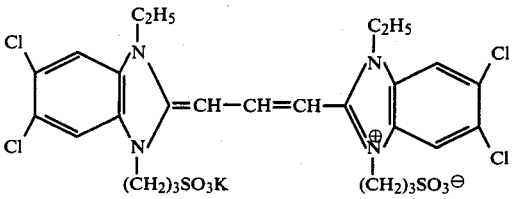
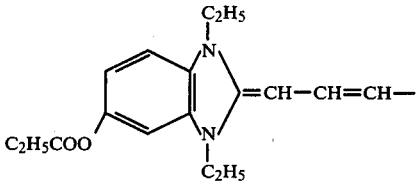
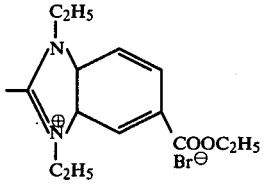
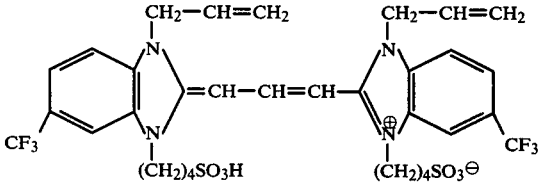
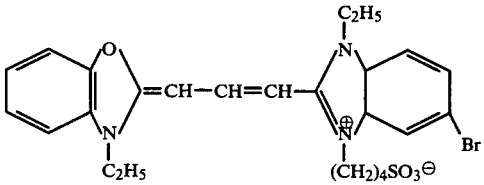
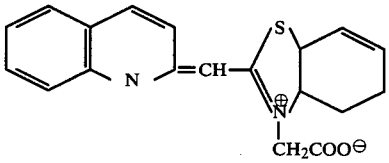
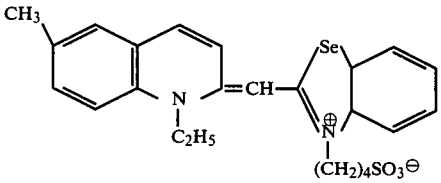
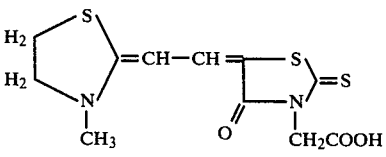
and -continued

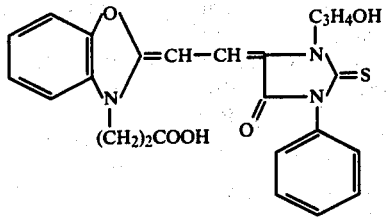

the improvement wherein at least one compound of the following general formula

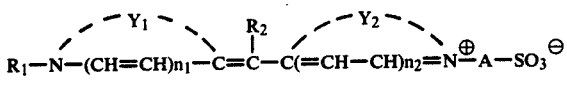

wherein $Y_1$, $Y_2$ each represents non-metallic atoms necessary to complete a nitrogen-containing heterocyclic ring selected from the group consisting of pyrroline, thiazoline, thiazole, benzothiazole, naphthothiazole, selenazole, benzoselenazole, naphthoselenazole, oxazole, benzoxazole, naphthoxazole, imidazole, benzimidazole or pyridine, and $R_1$ represents a lower alkyl group, hydroxyalkyl group, carboxyalkyl group or a sulfoalkyl group, $R_2$ represents a hydrogen atom or a lower alkyl group, A stands for an alkylene group, a group $-(CH_2)_2O(CH_2)_2-$ or a group $-(CH_2)_2OCH_2CHCH_2,-$ and $n_2$ represents 0 or 1 is present in either one or both of said red-sensitive silver halide emulsion layer and said green-sensitive silver halide emulsion layer.

2. A light-sensitive silver halide color photographic material as is defined in claim 1 wherein the nitrogen-containing heterocyclic ring is selected from the group consisting of benzoxazole, benzothiazole and benzoselenazole.

3. A light-sensitive silver halide color photographic material as is defined in claim 1 wherein the red-sensitive silver halide emulsion layer contains 0.08 to 0.5 g of the compound selected from the group consisting of;

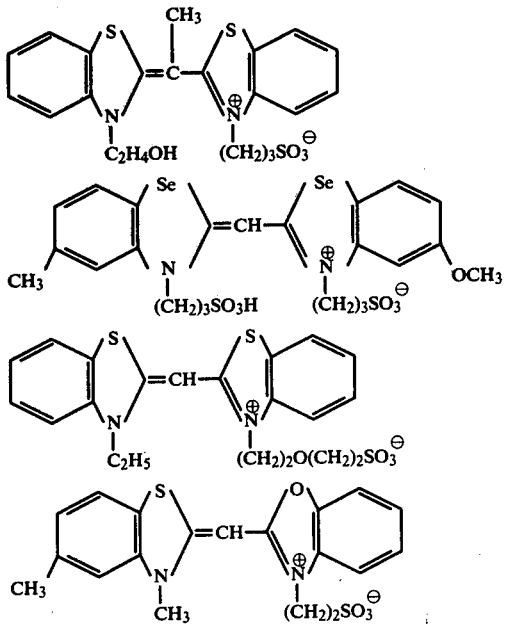

-continued

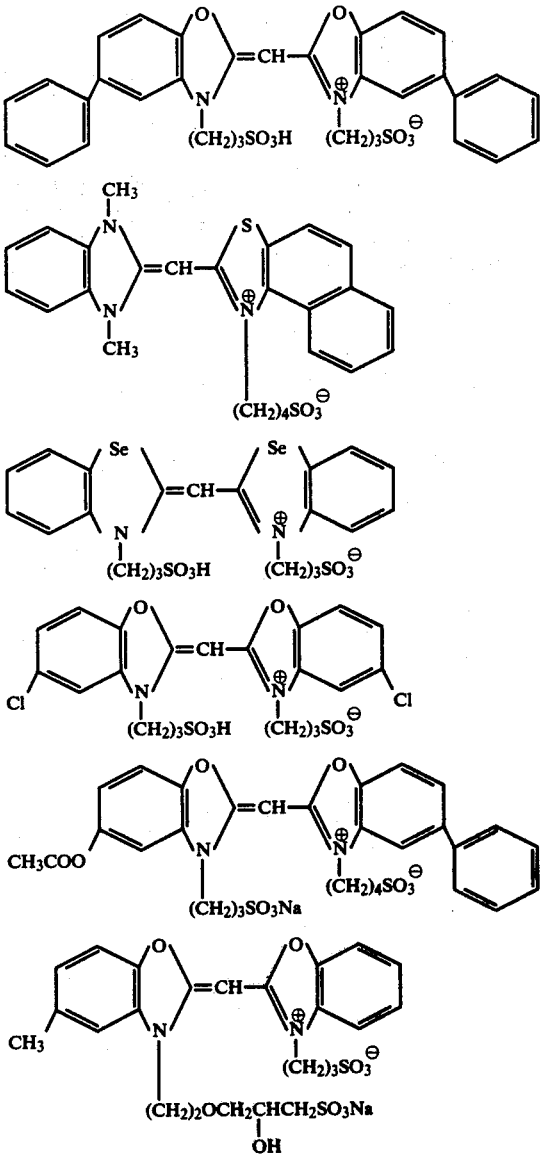

4. A light-sensitive silver halide color photographic material as is defined in claim 1 wherein the red-sensitive silver halide emulsion layer is sensitized with at least one of spectral sensitizing dyes selected from the group consisting of;

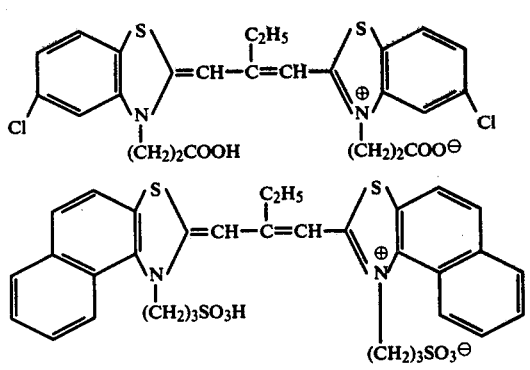

-continued

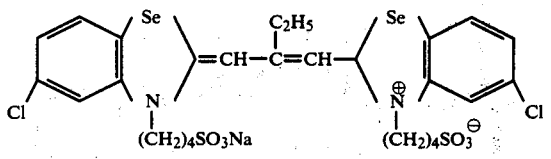

5. A light-sensitive silver halide color photographic material as is defined in claim 1 wherein the green-sensitive silver halide emulsion layer is sensitized with at least one of spectral sensitizing dyes selected from the group consisting of;

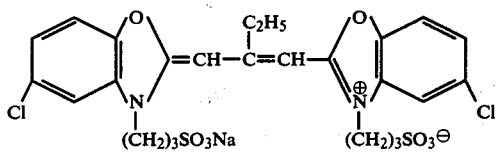

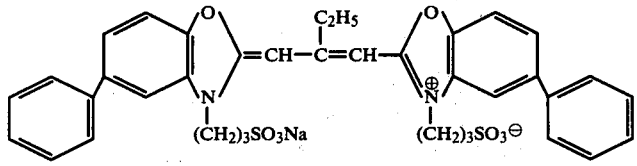

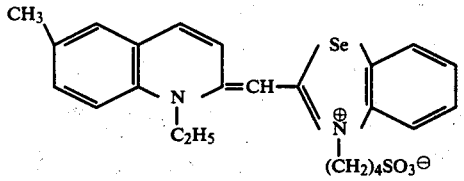

6. A light-sensitive silver halide color photographic material as is defined in claim 4 wherein the red-sensitive silver halide is silver iodobromide.

7. A light-sensitive silver halide color photographic material as is defined in claim 5 wherein the green-sensitive silver halide is silver iodobromide.

8. A light-sensitive silver halide color photographic material as is defined in claim 1 wherein said photographic material is a reversal type color photographic material.

9. A light-sensitive silver halide color photographic material as is defined in claim 1 wherein said photographic material is for high temperature processing.

* * * * *